US005201666A

United States Patent [19]

Markham

[11] Patent Number: 5,201,666

[45] Date of Patent: Apr. 13, 1993

[54] ADAPTER FOR ENABLING CONNECTION OF VINTAGE OIL FUSE CUTOUTS AND THE LIKE WITH MODERN CABLE LEAD CONNECTOR SYSTEMS

[75] Inventor: James P. Markham, Barrington, Ill.

[73] Assignee: Hotsplicer Corporation, Wauconda, Ill.

[21] Appl. No.: 794,373

[22] Filed: Nov. 14, 1991

Related U.S. Application Data

[63] Continuation of Ser. No. 481,577, Feb. 16, 1990, abandoned.

[51] Int. Cl.[5] ..... H01R 13/53; H01R 17/04

[52] U.S. Cl. ..... 439/186; 439/675; 439/921

[58] Field of Search ..... 439/181-186, 439/578-582, 675, 921

[56] References Cited

U.S. PATENT DOCUMENTS

| | | | |
|---|---|---|---|
| 3,673,546 | 6/1972 | Green et al. | 439/579 |
| 4,099,825 | 7/1978 | Jackson | 439/578 |
| 4,206,963 | 6/1980 | English | 439/581 |
| 4,824,399 | 4/1989 | Bogar et al. | 439/578 |
| 4,971,578 | 11/1990 | Wilson | 439/578 |

OTHER PUBLICATIONS

General Electric Co., "Sealed Oil Cutouts," 1984 catalog.

*Primary Examiner*—Cary F. Paumen
*Attorney, Agent, or Firm*—Rines and Rines

[57] ABSTRACT

A novel adapter for interfacing vintage oil fuse cutout devices with modern high-voltage cable terminations embodying a modern-standard bushing well at one end and a conductive member for mating with a cable entrance terminal of the cutout at the other end, and with mechanical (threaded) coupling to the device.

11 Claims, 5 Drawing Sheets

ADAPTER FOR ENABLING CONNECTION OF VINTAGE OIL FUSE CUTOUTS AND THE LIKE WITH MODERN CABLE LEAD CONNECTOR SYSTEMS

This is a continuation of application Ser. No. 481,577 filed Feb. 16, 1990, now abandoned.

The present invention relates to oil fuse switch cutout devices and circuits, being more particularly concerned with adapting vintage oil fuse cutout terminals for interfacing with modern cable lead connector systems.

BACKGROUND

Vintage oil fuse cutout devices, as, for example, of the types manufactured by the General Electric Company and described in their 1984 catalog sheet "Sealed Oil Cutouts" S-125, S-130, etc., have been provided with detachable or non-detachable wiping sleeve terminals and other terminations for connection with rubber or lead-covered high voltage input and output cables. For years such connections were effected by removing the insulation covering and outer protective jackets of the cables to expose the inner jacket. The conductor was soldered to a sleeve that mated to a part of the oil fuse. Since the cable insulation and protective jackets had to be disturbed or destroyed, they were then meticulously repaired, using some combination of insulating and conductive tapes, heat-shrink tubes and lead wiping (with sleeves) in a labor-intensive operation requiring specialized personnel. Such semi-permanent installations, moreover, could only be modified (for cable or equipment interchange) by repeating the same termination process.

In current years, modern high voltage cables (up to say 35 Kilovolts) are field adaptable to the new factory-made terminations; in particular, terminations adapted to mate with later-described ANSI/IEEE Standard 386-1985 connections that are not compatible with the terminals of the vintage oil fuse cutout devices. Utilities, however, have much of such vintage equipment in serviceable use, incorporating the older electrical connection techniques previously described. Replacement would be inordinately expensive and, in view of the present invention, unnecessary. The invention provides novel adapters designed to present the required interfaces for adapting the vintage equipment bushings and terminations to connect with the modern cable terminations, now permitting the utility inexpensively to connect the standardized new cable terminations to the vintage installed oil fuse cutout equipments and the like.

OBJECT OF INVENTION

The object of the invention, thus, is to provide a novel adapter for permitting older oil fuse cut off devices to interface with and be readily converted to and disconnectable from modern cable terminations.

A further object is to provide such a new adapter that is specific for ANSI/IEEE Standard 386-1985 cable connector systems and the like.

Other and further objects will be explained hereinafter and are more particularly pointed out in connection with the appended claims.

SUMMARY

In summary, however, the invention embraces an adapter for converting oil an fuse cutout cable entrance of the type utilized with sleeve terminals adapted for cable solder and taping connections to interface with bushing-well type cable connector systems having, in combination, an externally ground-shielded cylindrical insulating adpater body internally provided at one end with an inner conductive member for slidingly fitting to a high voltage terminal of the entrance to establish electrical connection therewith, and with a surrounding external securing means for establishing mechanical and outer-surface connection; the adapter being integrally provided at its other end with a re-entrant bushing-well type connector adapted to receive standardized bushing inserts therefor for enabling cable connection thereto, and the bushing-well type connector being provided with an inner terminal extending to said conductive member within and along the adapter body.

Preferred and best mode embodiments are hereinafter described in detail.

DRAWINGS

The invention will now be described with reference to the accompanying drawings, FIG. 1 of which is a side elevation of a vintage oil fuse cutout device, connected by older cable-stripping, wiping and connecting techniques to input and output high voltage cables;

DESCRIPTION

Figure 1:
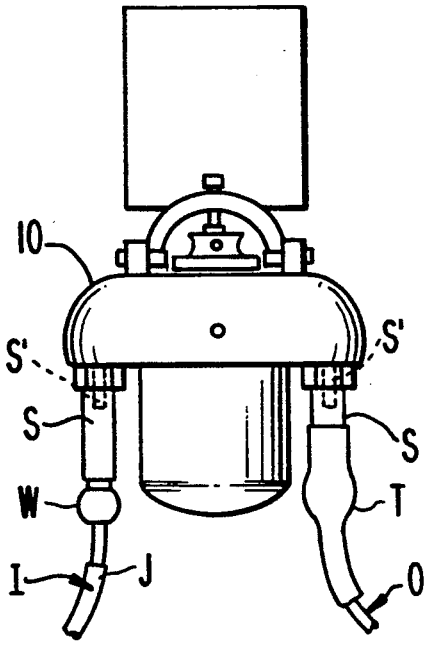
FIG. 1 PRIOR ART

Referring to FIG. 1, the illustrative vintage oil fuse cutout with cable entrances CE (see FIG. 3A) is shown at 10 with the before-described input cable I and output cable O wiped (wipe W), soldered and taped with the sleeves S by the older connection techniques previously described. The input cable connection is shown in a condition prior to application of a heat shrink tube over the corresponding sleeve S, wipe W, and cable jacket J cut back from inner conductor C. The output cable connection is shown with a heat shrink tube T applied.

Figure 2A:
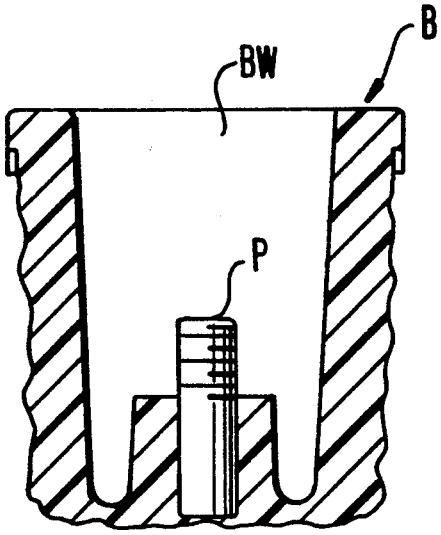
FIG. 2A PRIOR ART
FIG. 2A is a transverse sectional view of the before-mentioned ANSI/IEEE 386-1985 new standard for separable insulated connector systems, particularly designed for a bushing-well interface, and FIG. 2B also shows an elbow particularly useful for underground installations with such bushings.
Figure 2B:
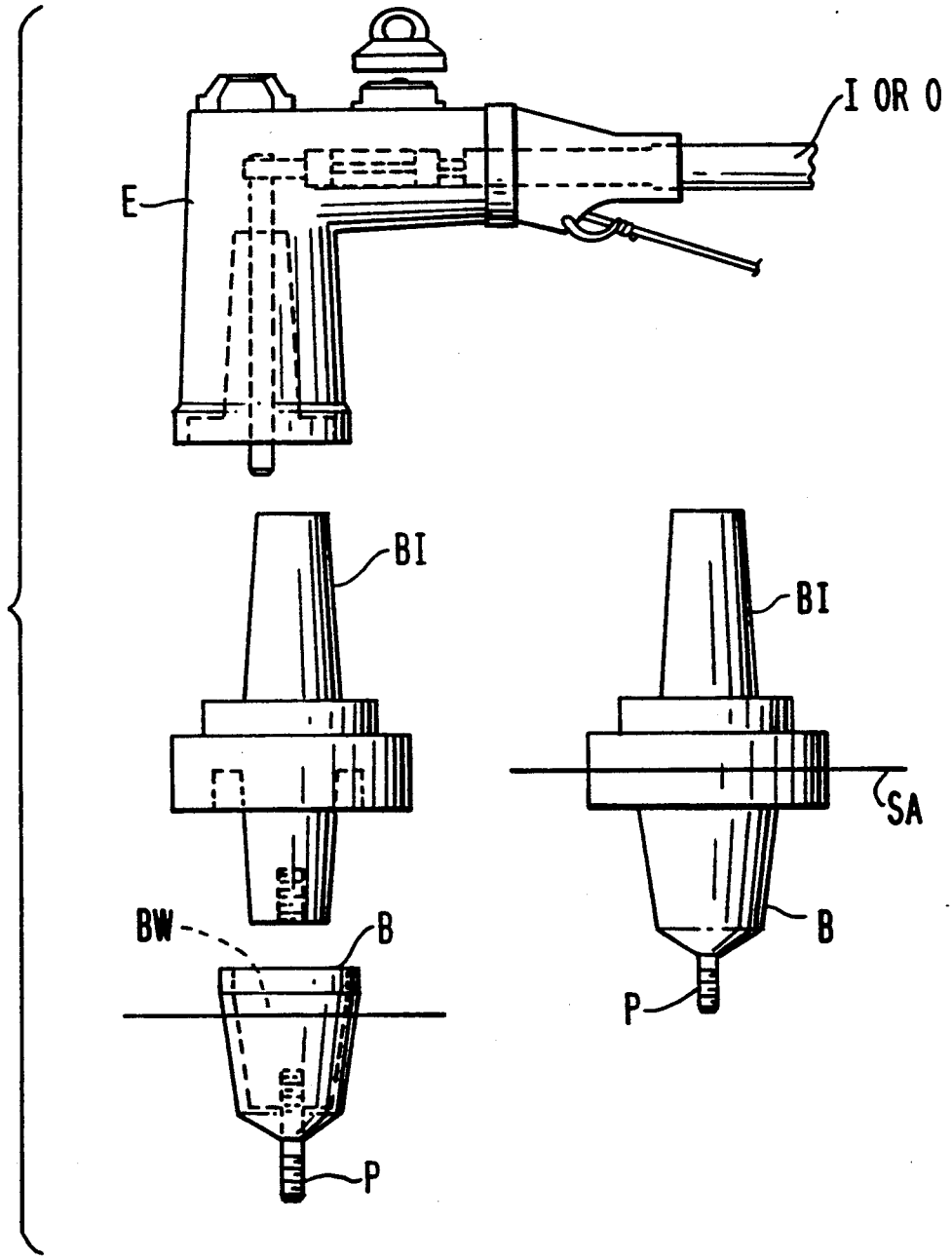
FIG. 2B PRIOR ART

By contrast, FIGS. 2A and 2B are illustrative of the modern standardized separable insulated connector systems of the ANSI/IEEE 386-1985 types, FIG. 2B showing a standard bushing well connector B mounted through a surface SA of an apparatus for connection to an input or output cable I or O via a standard bushing insert BI and a standard elbow E. The unsuitability of the aforementioned sleeves S and the standard externally threaded bushings 12 and standard high voltage terminals S' (see also FIG. 3A) of the cutout 10 for connection in such modern systems as shown in FIGS. 2A and 2B will be readily evident from the geometry of the re-entrant bushing wells BW and internal threaded probe terminals P of such systems.

Figure 3A:
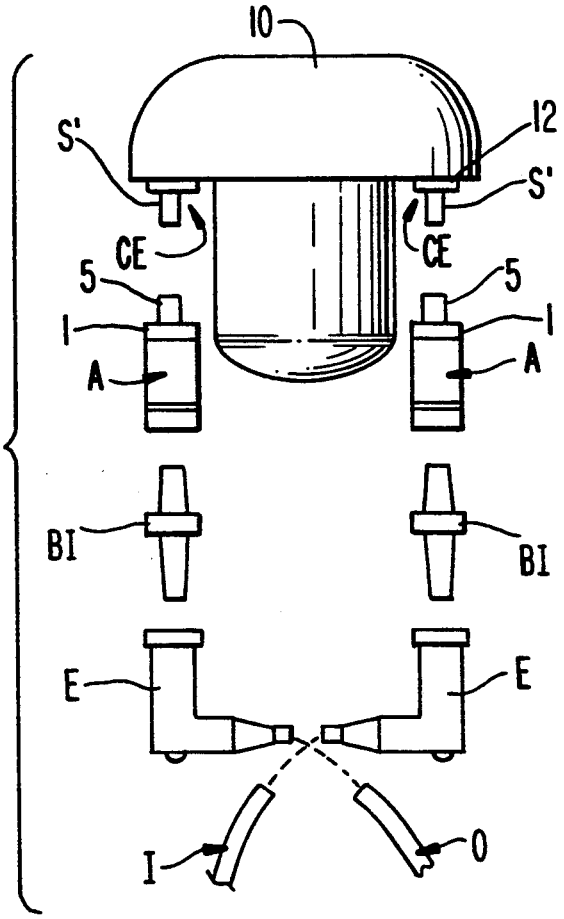
FIGS. 3A and 3B are, respectively, views of such standard bushings and elbows preparatory to assembly with the adapter of the invention and after such assembly with a vintage oil fuse cutout device.
Figure 3B:
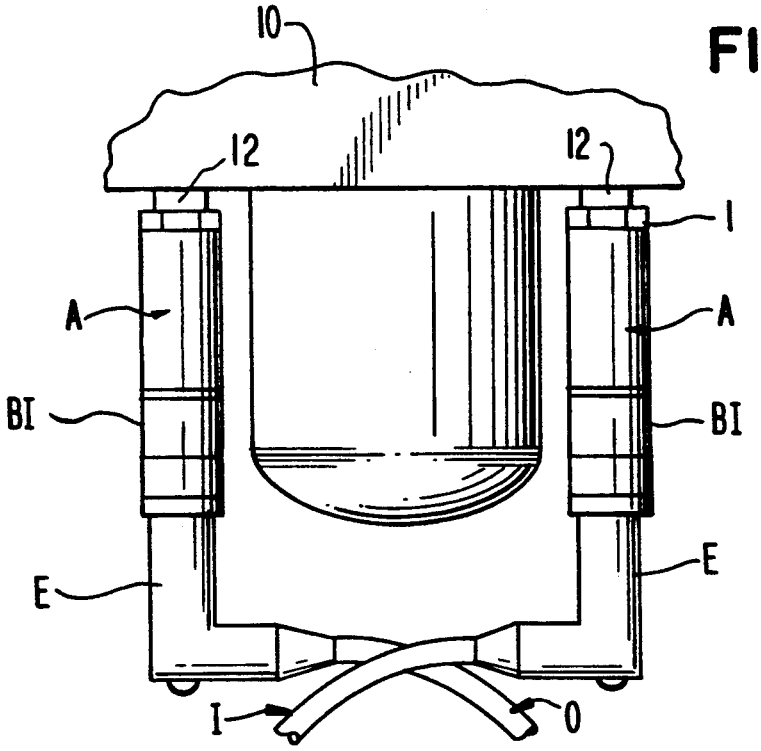

In accordance with the present invention, however, novel cylindrical adaptors A are provided, FIG. 3A, the details of which are later described in connection with FIG. 5, that, in conjunction with standard bushing inserts BI and elbows E of FIGS. 2A and 2B, will permit ready interfacing connections with (and disconnections from) the vintage oil fuse 10, as in FIG. 3B.

The input and output cables I and O are quickly fitted with the standard elbows E. The adapter A is attached to the oil fuse 10 by sliding together mating electrical contacts (the later-described resilient split connector (copper electrode) 2, FIG. 5, and high voltage terminal S', FIGS. 1 and 3A) and firmly engaging a mechanical (threaded) coupling member 1 of the adapter (FIG. 5) and bushing 12 (FIGS. 1 and 3A). By use of a standard bushing insert BI, the input and output cable/elbows E are electrically connected through the adapter A to the oil fuse in a matter of minutes (FIG. 3B). Future replacement of or substitution for the oil fuse is also vastly simplified.

Figure 5:
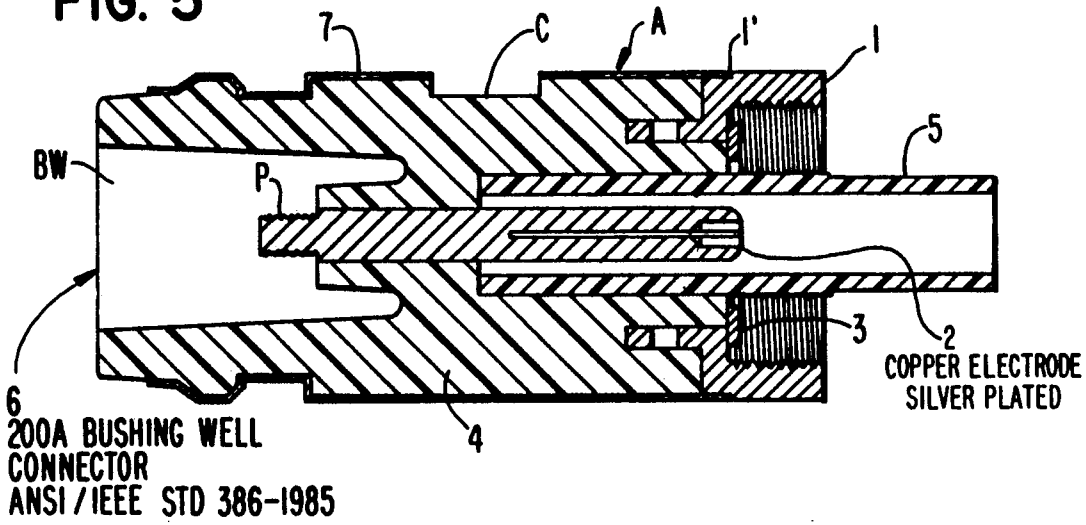
FIG. 5 is a transverse section of FIG. 4 showing details of preferred construction.

Turning, now, to the details of the preferred or best mode design for the adapter of the invention, reference is made to the cross-sectional view of FIG. 5. A generally cylindrical insulating body 4, as of cycloaliphatic epoxy or the like, is provided at one end (right-hand end in the drawing) with a conductive threaded sleeve or union nut 1, preferably of brass, molded or otherwise integrally fixedly attached to that end of the adapter body 4. This construction enables a firm mechanical and electrical attachment to the mating apparatus 12 of the oil fuse cutout 10, FIGS. 3A and 3B. Protruding from the right-hand end of the adapter is an insulating cylinder or tube 5 coaxially internally mounted within the body 4, and within which a smaller-diameter coaxial resiliently slotted copper connector 2 extends from a bushing well connector 6 provided at the other (left-hand) end of the body 4. The tube 5 guides the copper connector 2 (male) as it slides over and electrically connects with the standard cutout high voltage terminal S' (female). The threaded union nut 1 locks or secures with thread of cutout bushing 12, enabling ready mechanical connection to the before-described vintage apparatus of the oil fuse cutout or similar device.

The bushing well connector 6 may, for example, be a 200 ampere well, formed to ANSI/IEEE Standard 386-1985 geometry and dimensions previously mentioned, with re-entrant well BW and threaded probe or terminal P adapted to receive bushing inserts and elbows, in turn separably connectable to cable lead connectors of modern types. The inner end wall of the nut 1 may be provided with an 0-ring gasket 3 (nitrile, for example). The copper electrode 2 may be silver plated at its sleeve end and is shown with its slotted resilient free end terminating near the end wall of the nut 1 within the gasket 3. The circumferential outer surface of the adapter body 4 may be covered with a continuous conducting or partially conducting shielding surface 7 as of conductive paint, a metallized coating, a molded conducting rubber sleeve or a combination of such, to serve as a grounded protective covering, with the high voltage current confined to the center conductor path 2. When the device is installed with threaded nut union or securing with the mating threaded cutout bushing, the internal high voltage path is extended into the bushing well electrode P, and with surface grounding potential connection continuous over the adapter A and connecting with the conductive nut 1 at 1', FIG. 5, and cutoff bushing to which it is secured.

The adapter of the present invention thus, in effect, converts the input and output bushings of vintage oil fuse cutout devices with older type cable entrance sleeves for use with newer industry standardized bushing well and connector terminations now widely used with "synthetic" covered cables. The older technique of laborious hand-attachment of older lead or rubber-covered cables is obviated, and conversion for use with any standard component of separable insulated connector systems is achieved.

Figure 4:
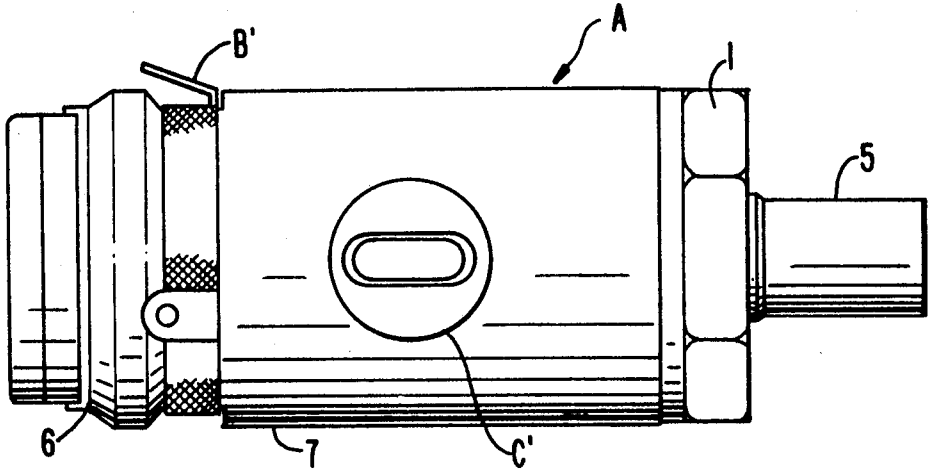
FIGS. 4 and 6 are, respectively, side and end elevations, upon an enlarged scale, of the adapter of the invention shown in FIGS. 3A and 3B.
Figure 6:
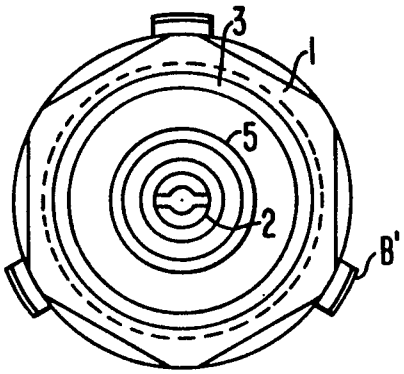
Figure 7A:
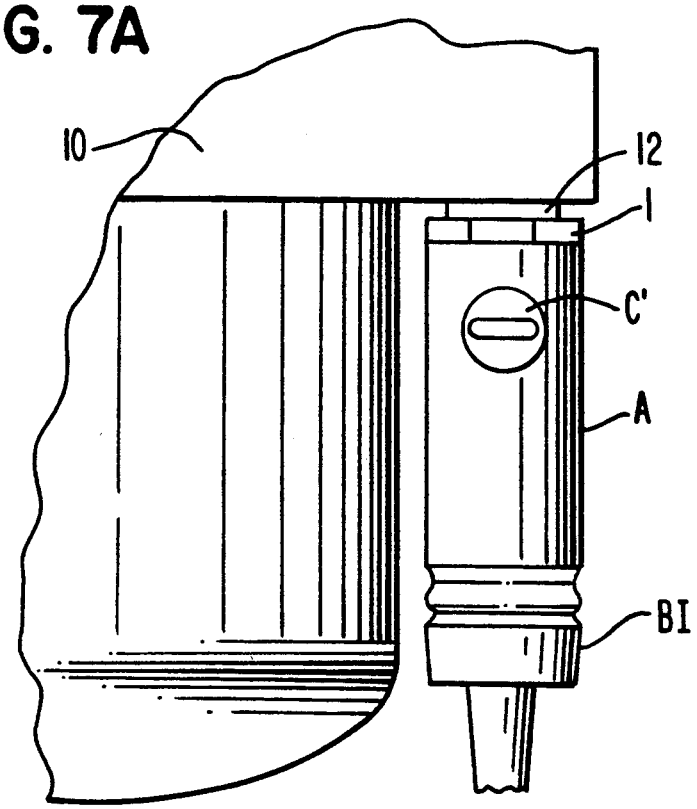
FIGS. 7A and 7B are views of a voltage or current indicator attached to the capacitance test point of the adapter of FIGS. 4 and 5 after removal of the test point cap on the adapter body.
Figure 7B:
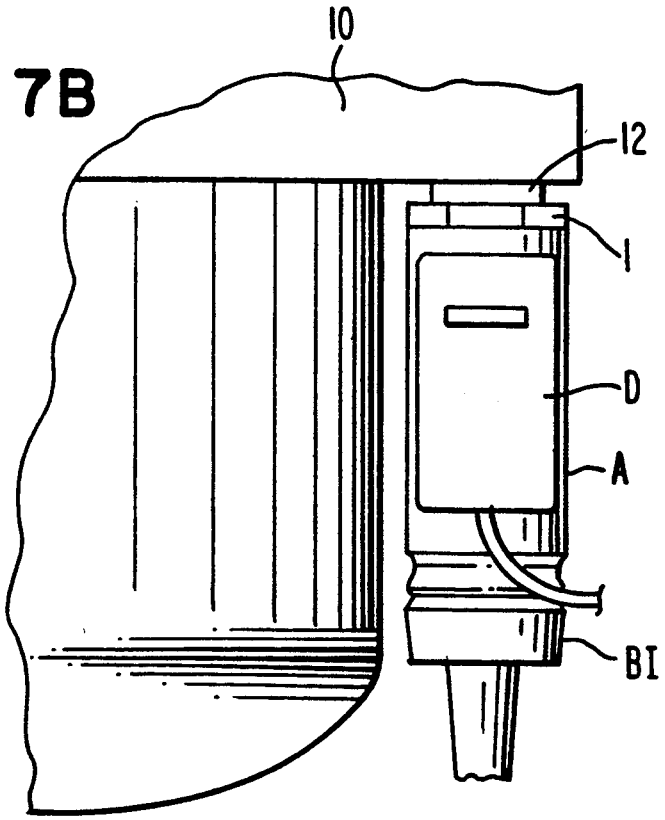

Bail tabs B', FIG. 4, may be provided circumferentially of the adapter near the bushing well end; and an unshielded region or opening in the shield surface may also be intermediately provided at C for enabling a capacitance test point at which test indications may be obtained by voltage sensing devices, such as test point reset fault indicators D of the type TPR described, for example, in the June 1987 catalog sheet of RTE Corporation, or similar voltage or current indicators as for determining if the circuit is energized or to measure current flow. The test point cap C' of FIGS. 4 and 7A will be removed, and the test equipment D applied at the test point, FIG. 7B, as is well known. Other auxiliary functions may also be incorporated, if desired.

While the mechanical coupling of the adapter to the cutout is shown effected by simple nut and thread union, other locking mechanisms may be used and further modifications will also occur to those skilled in this art, such being considered to fall within the spirit and scope of the invention as defined in the appended claims.

What is claimed is:

1. In combination with an oil fuse cutout, having a cable entrance of the type for use with a sleeve adapted for cable solder and taping connection, an adpater for converting said cable entrance to interface with bushing-well type cable connector systems, said adapter comprising an externally ground-shielded cylindrical insulating adapter body provided at one end with an internal conductive member slidingly fitted to a high voltage terminal of said cable entrance to establish electrical connection therewith, and further provided at said one end with a surrounding external securing means establishing mechanical and electrical outer-surface connection to said cable entrance, the adapter body being integrally provided at its other end with a re-entrant bushing-well type connector adapted to receive a standardized bushing insert connector for enabling cable connection to the bushing-well type connector, and the bushing-well type connector being provided with an inner terminal extended from said conductive member within and along the adapter body to complete an electrical connection of the cable to said high voltage terminal of said cable entrance.

2. The combination as claimed in claim 1 and in which said conductive member is surrounded by an insulating tube of greater diameter but less than that of the adapter body and protruding forward of the conductive member and of the adapter body at said one end, the tube guiding the conductive member along said high voltage terminal.

3. The combination as claimed in claim 2 and in which said conductive member is slotted at a free end thereof to provide a resilient connection with said high voltage terminal and extends within said insulating tube only substantially to the region of said external securing means of the adapter body at said one end thereof.

4. The combination as claimed in claim 1 and in which said bushing insert connector is connected with a standardized elbow connected with a high voltage cable.

5. The combination as claimed in claim 4 supplemented by a similar adapter with a similar bushing insert and elbow, one adapter connecting a high voltage input cable to said sleeve terminal through the corresponding elbow and bushing insert connector, and the other adapter connecting a high voltage output cable to a second said sleeve terminal of the cutout through its corresponding elbow and bushing insert.

6. The combination as claimed in claim 5 and in which the respective bushing-well type connectors, bushing insert connectors, and elbows are of the ANSI/IEEE Standard 386-1985 type.

7. The combination as claimed in claim 1 and in which the adapter body is externally covered with a conducting shield surface.

8. The combination as claimed in claim 7 and in which an opening is provided in said shield surface to provide a capacitance test point for permitting current or voltage indicating equipment to be attached thereto.

9. The combination as claimed in claim 1 and in which bail tab means is provided circumferentially of the adapter body near said other end thereof.

10. A method of converting high voltage electrical apparatus, such as an oil fuse cutout, having a cable entrance of the type for use with a sleeve adapted for cable solder and taping connection, to interface with a bushing-well type cable connector system, said method comprising the following steps:

providing an adapter having an externally ground-shielded cylindrical insulating adapter body provided at one end with an internal conductive member for slidingly fitting to a high voltage terminal of said cable entrance and further provided at said one end with a surrounding external securing means for establishing mechanical and electrical outer-surface connection to the cable entrance, the adapter body being integrally provided at its other end with a re-entrant bushing-well type connector adapted to receive a standardized bushing insert connector for enabling cable connection to the bushing-well type connector, and the bushing-well type connector being provided with an inner terminal extending to said conductive member within and along the adapter body and electrically connecting to said conductive member;

slidingly fitting said conductive member of the adapter to said high voltage terminal of said cable entrance to establish an electrical connection therewith and securing said securing means to said cable entrance to establish a mechanical and electrical outer-surface connection to said cable entrance; and inserting a bushing insert connector into said bushing-well type connector of the adapter and connecting a high voltage cable to said bushing insert connector, so that the cable is electrically connected to said high voltage terminal of said cable entrance through said bushing insert connector, and through said bushing-well type connector and said conductive member of the adapter.

11. The method of claim 10, wherein the high voltage cable is connected to said bushing insert connector via a standard elbow.

* * * * *